US006412676B1

(12) United States Patent
Stallings

(10) Patent No.: US 6,412,676 B1
(45) Date of Patent: Jul. 2, 2002

(54) POOL EQUIPMENT CARRIER

(76) Inventor: Zack Stallings, 224 Busbin Rd., Fayetville, GA (US) 30214

( * ) Notice: Subject to any disclaimer, the term of this patent is extended or adjusted under 35 U.S.C. 154(b) by 0 days.

(21) Appl. No.: 09/507,856

(22) Filed: Feb. 22, 2000

(51) Int. Cl.[7] ..... A45F 3/02

(52) U.S. Cl. ..... 224/611; 224/600; 224/601; 224/623

(58) Field of Search ..... 224/611, 600, 224/607, 623, 604; 383/24, 38, 39, 40; 150/107, 117; 190/111; 294/153, 154, 155

(56) References Cited

U.S. PATENT DOCUMENTS

| | | | | | |
|---|---|---|---|---|---|
| 3,929,224 | A | * | 12/1975 | Smith, Jr. | 383/39 X |
| 4,164,968 | A | * | 8/1979 | Esposito, Jr. et al. | 383/39 X |
| 4,804,025 | A | * | 2/1989 | Bear | 224/604 |
| 4,859,084 | A | * | 8/1989 | Kaumeyer | 383/39 |
| 4,960,204 | A | * | 10/1990 | Young et al. | 190/111 |
| 5,695,101 | A | | 12/1997 | Frietze | |
| 5,779,033 | A | * | 7/1998 | Roegner | 383/39 X |

* cited by examiner

*Primary Examiner*—Stephen K. Cronin
*Assistant Examiner*—Maerena W. Brevard
(74) *Attorney, Agent, or Firm*—Kilpatrick Stockton LLP

(57) ABSTRACT

A carrier for carrying pool maintenance equipment comprising a substantially flat and flexible panel partitioned into a plurality of pockets. The panel is constructed from a substantially water-resistant and substantially chemical resistant material, such as vinyl coated polyester. A support bar affixed to the top edge of the panel supports the weight of the carrier. An adjustable shoulder strap is affixed to the support bar for carrying the carrier. An adjustable hose strap is affixed to the support bar and is configured for securing a coiled pool hose to the front side of the panel. The plurality of pockets of the carrier may comprise three pockets aligned vertically along the front side of the panel. A first pocket may be positioned in proximity to the top edge of the panel and may be sized to accommodate a commercial-grade skimmer net or a commercial-grade leaf rake. A second pocket may be positioned immediately below the first pocket and may be sized to accommodate a commercial-grade pool brush. A third pocket may be positioned immediately below the second pocket and may be sized to accommodate a commercial-grade vacuum head. In an alternate embodiment, a first pocket may be positioned in proximity to the top edge of the panel and may be sized to accommodate a residential-grade skimmer net or a residential-grade leaf rake. A second pocket may be positioned immediately below the first pocket and may be sized to accommodate a residential-grade vacuum head. A third pocket may be positioned immediately adjacent to the second pocket below the first pocket and may be sized to accommodate a residential-grade pool brush. Other pockets configurations are contemplated as well.

20 Claims, 6 Drawing Sheets

POOL EQUIPMENT CARRIER

TECHNICAL FIELD OF THE INVENTION

The present invention relates generally to devices for carrying swimming pool maintenance equipment. More particularly, the present invention is directed to a novel and improved apparatus for conveniently carrying equipment commonly used for cleaning and maintaining swimming pools.

BACKGROUND OF THE INVENTION

It is well known that swimming pools require periodic maintenance to keep them clean and operational. However, it is also well know that pool maintenance equipment can be cumbersome and difficult to manage. Persons charged with maintaining swimming pools are often faced with the task of carrying pool maintenance equipment from a storage location in proximity to the pool or from a vehicle used to transport the equipment. Pool maintenance equipment typically includes such items as hoses, vacuum heads, rods or poles, skimmer nets, leaf rakes, brushes, water testing and treatment kits, and various chemicals. Often, several trips are required to bring the necessary equipment and chemicals to the swimming pool. Accordingly, there is a need for an apparatus for conveniently carrying an array of pool maintenance equipment to and from a swimming pool. What is needed is a low-cost, easy to manufacture carrier for carrying pool maintenance equipment.

In addition, due to its cumbersome nature, pool maintenance equipment is prone to being dropped or thrown onto poolside decks, truck beds, or other hard surfaces. Pool equipment is also prone to being dragged along the poolside decks. As a result of such rough handling, pool maintenance equipment is often subject to unnecessary wear and tear. Thus, there is a need for an apparatus that makes carrying pool maintenance equipment easy so that it is not dropped or dragged along the ground. The apparatus must be durable so as to shield pool maintenance equipment from scratches and dents normally caused by contact with hard and/or rough surfaces.

SUMMARY OF THE INVENTION

The present invention provides a novel and improved carrier for carrying pool maintenance equipment. The carrier comprises a substantially flat and flexible panel partitioned into a plurality of pockets. The panel is constructed from a substantially water-resistant and substantially chemical resistant material, such as vinyl coated polyester. A support bar is affixed to the top edge of the panel is such a way as to be parallel to the top edge. A shoulder strap is affixed to the support bar for carrying the carrier. The shoulder strap of the carrier is adjustable in length and includes a shoulder pad for the comfort of the user. Also, a hose strap is affixed to the support bar and is configured for securing a coiled pool hose to the front side of the panel. The hose strap is adjustable in length so as to accommodate various lengths of pool hoses.

In one embodiment, the plurality of pockets of the carrier comprises three pockets aligned vertically along the front side of the panel. A first pocket is positioned in proximity to the top edge of the panel and is sized to accommodate a commercial-grade leaf rake or skimmer net. A second pocket is positioned immediately below the first pocket and is sized to accommodate a commercial-grade pool brush. A third pocket is positioned immediately below the second pocket and is sized to accommodate a commercial-grade vacuum head.

In an alternate embodiment, a first pocket is positioned in proximity to the top edge of the panel and is sized to accommodate a residential-grade skimmer net or leaf rake. A second pocket is positioned immediately below the first pocket and is sized to accommodate a residential-grade vacuum head. A third pocket is positioned immediately adjacent to the second pocket below the first pocket and is sized to accommodate a residential-grade pool brush. Other pockets configurations are contemplated as well.

One or more pockets of the carrier may include a drainage point that allows water to be drained from the carrier. The openings of the pockets may also be outfitted with a fastening device, such as Velcro. The pockets may optionally be pleated to provide expandability. These and other features of the invention will be further described below, with reference to the drawings.

DETAILED DESCRIPTION OF THE PREFERRED EMBODIMENTS

Figure 1:
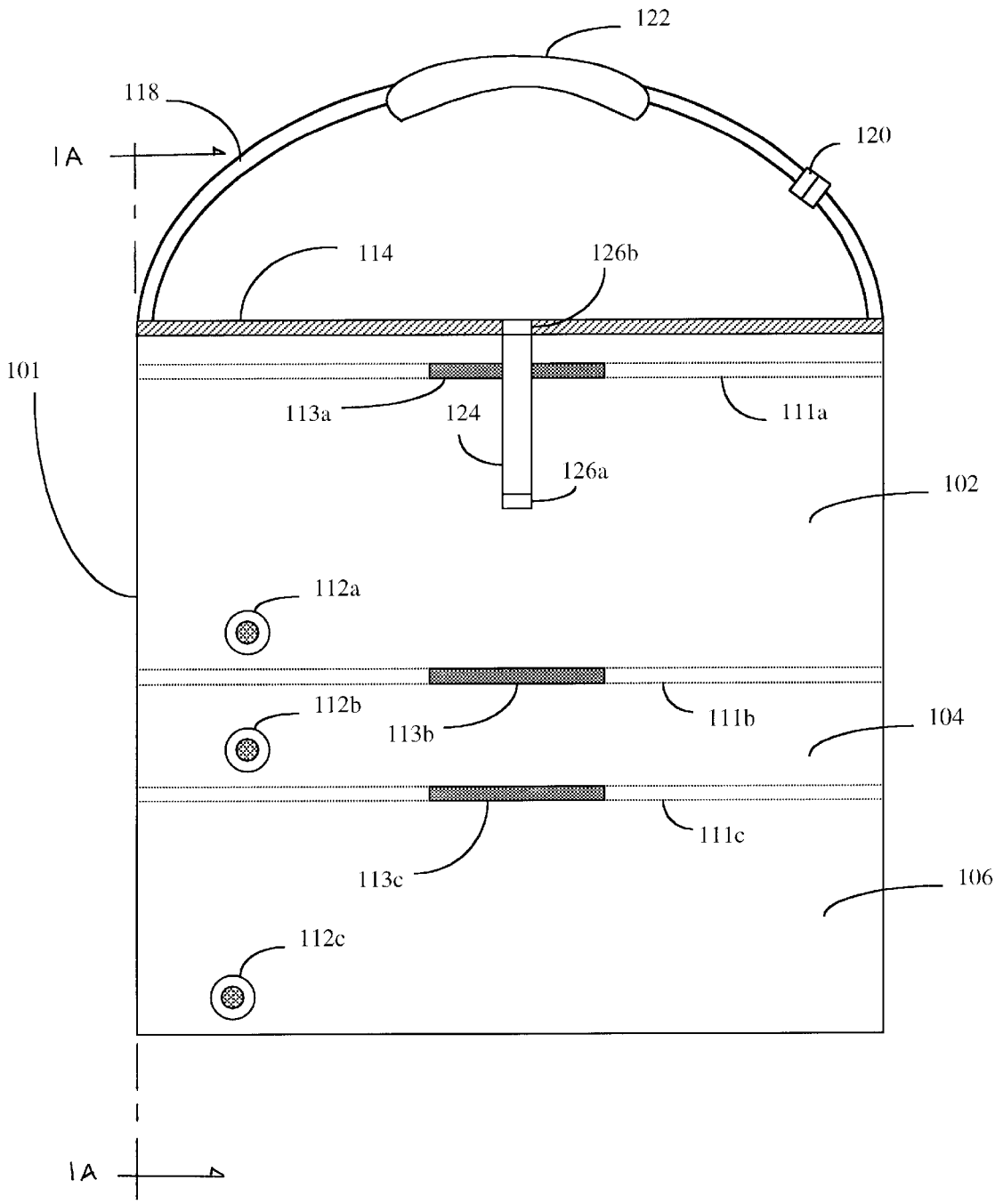
FIG. 1 is a front view of an exemplary carrier of the present invention.
Figure 1A:
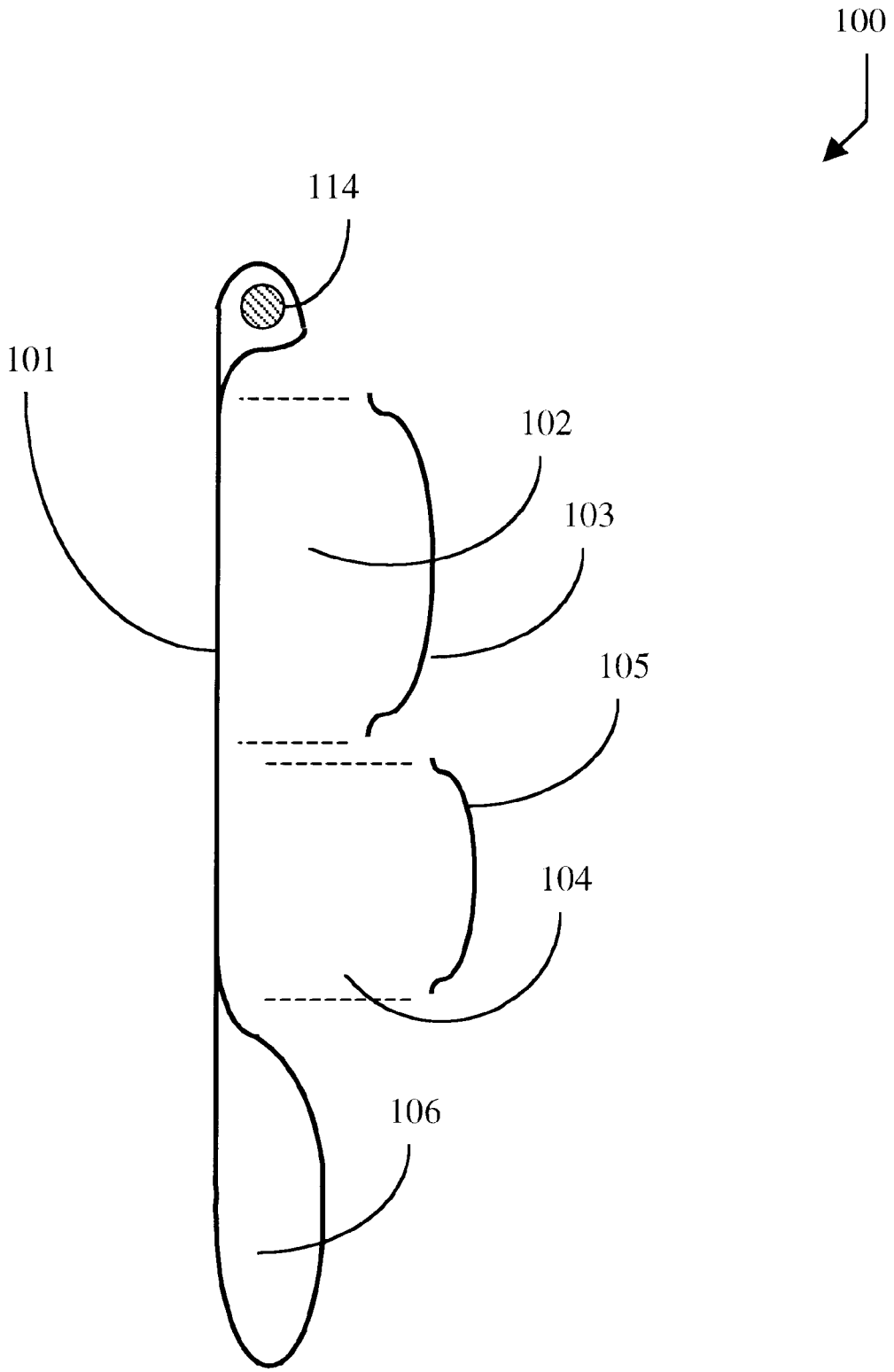
FIG. 1A is a cross-section view as seen along line 1A—1A.
Figure 2:
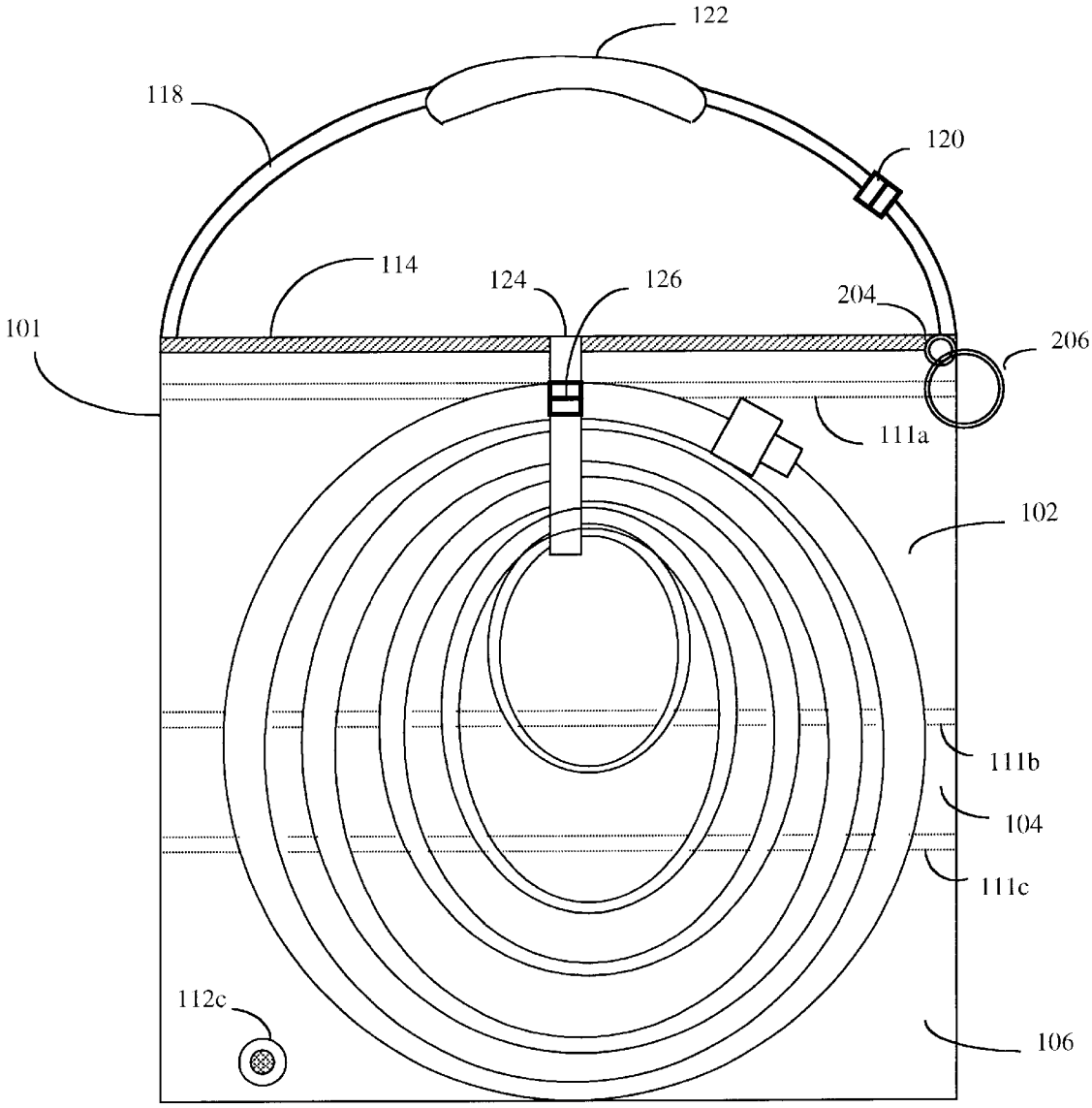
FIG. 2 is a front view of an exemplary carrier of the present invention having a pool hose attached thereto.
Figure 3:
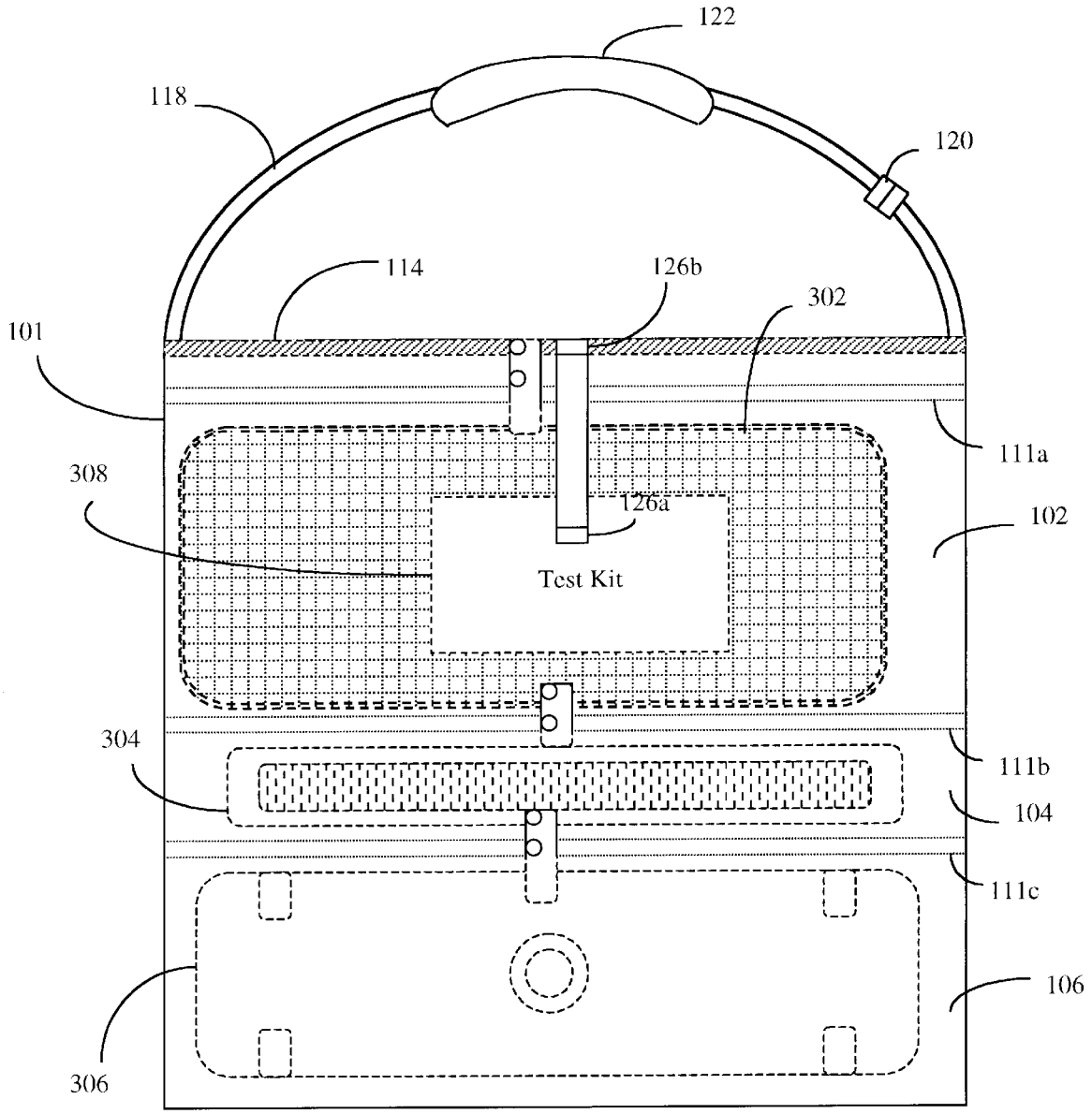
FIG. 3 is a front view of an exemplary commercial-grade carrier of the present invention with the contents of various pockets shown in ghost view.
Figure 4:
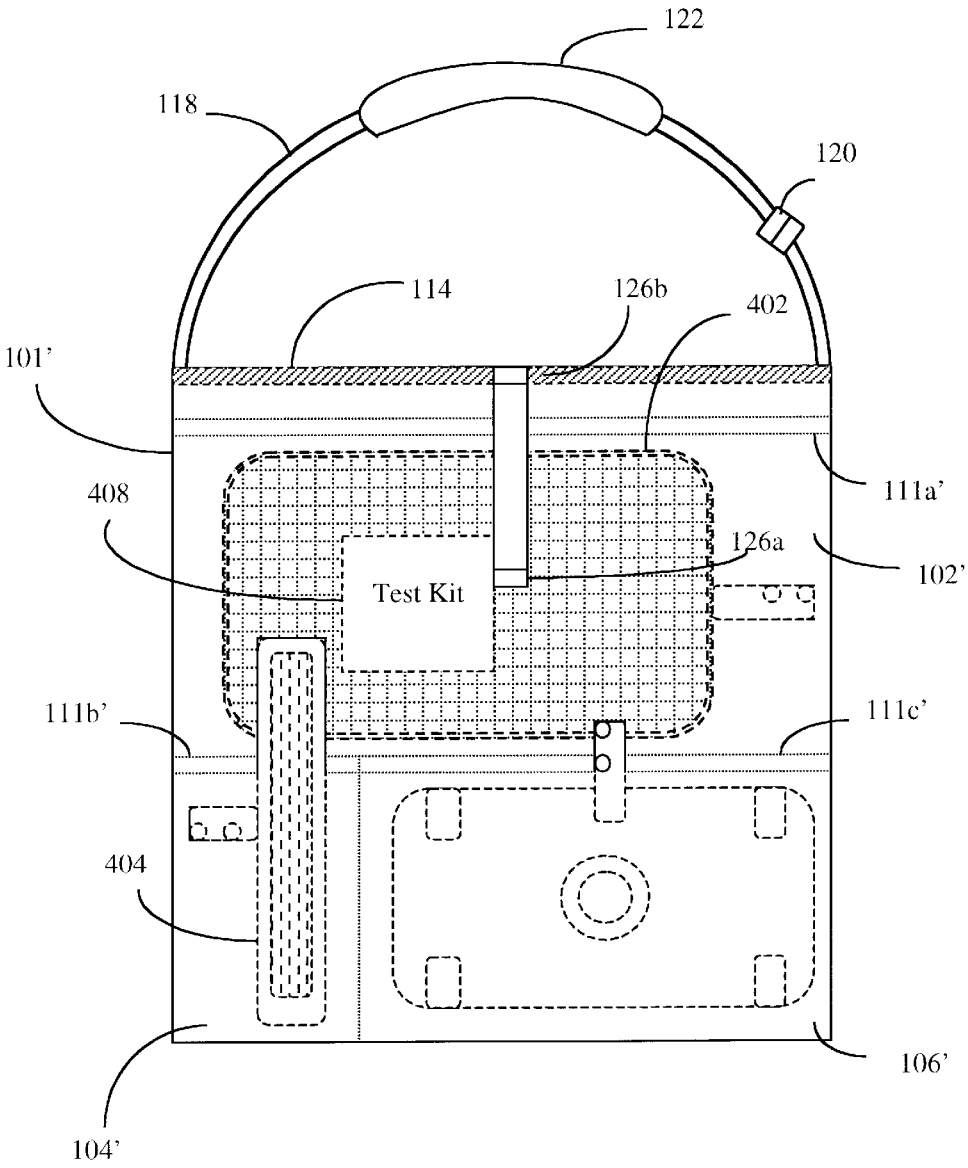
FIG. 4 is a front view of an exemplary residential-grade carrier of the present invention with the contents of various pockets shown in ghost view.
Figure 5:
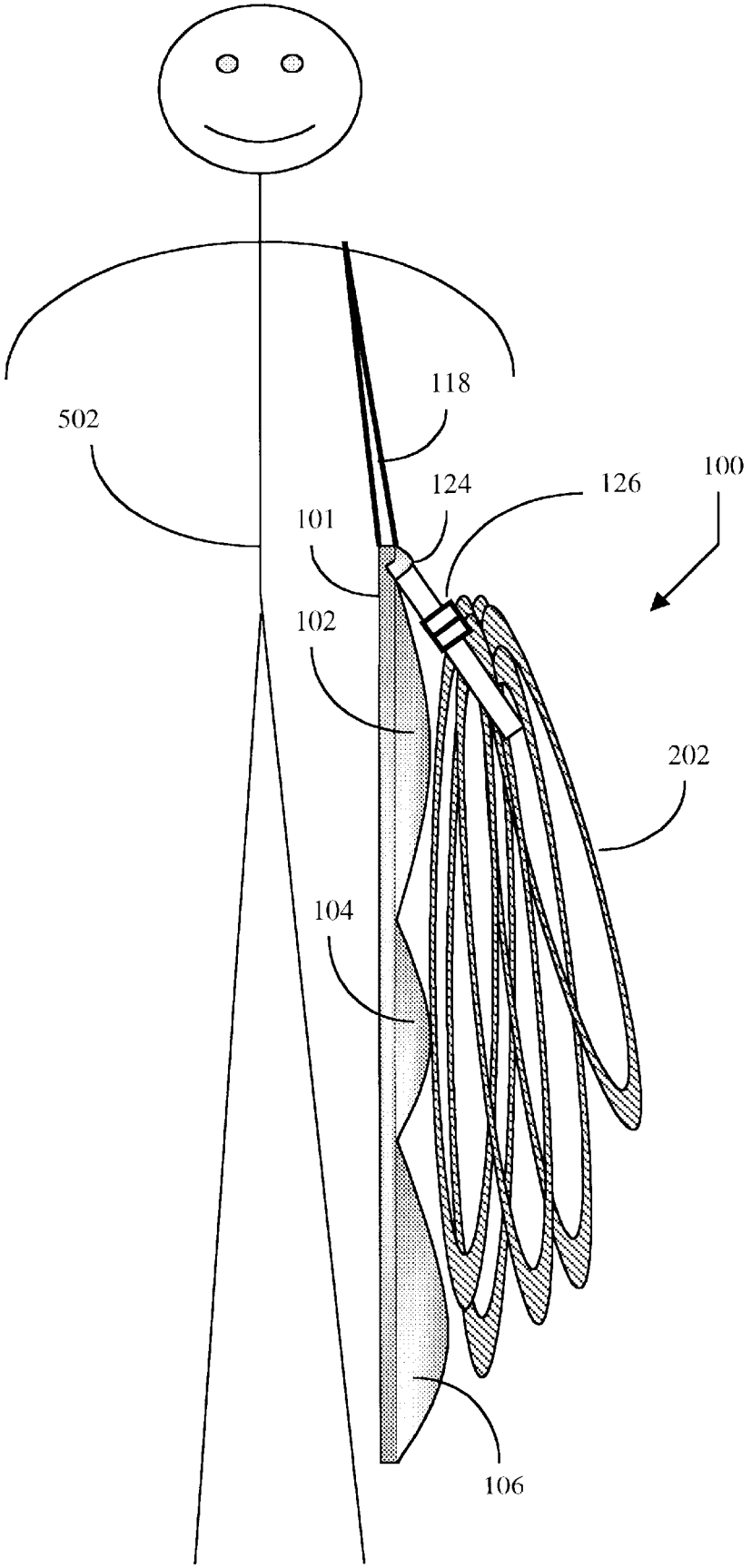
FIG. 5 is an illustration of the manner in which an exemplary carrier of the present invention is intended to be carried by a person.

Exemplary embodiments of the present invention will hereinafter be described with reference to the drawings, in which like numerals indicate like elements throughout the several figures. In particular, FIG. 1 is a front view of a carrier 100 in accordance with the present invention. FIG. 1A is a side illustrating the construction of a carrier in accordance with the present invention. FIG. 2 is a front view of the carrier 100 having a pool hose 200 attached thereto. FIG. 3 is a front view of the carrier 100 with the contents of its various pockets shown in ghost view. The carrier 100 of FIG. 3 is configured to store commercial-grade pool equipment, and may thus be referred to herein as a "commercial-grade carrier" or a "commercial carrier." FIG. 4 is a front view of an alternate carrier 100' with the contents of its various pockets shown in ghost view. The alternate carrier 100' of FIG. 4 is configured to store residential-grade pool equipment, and may thus referred to herein as a "residential-grade carrier" or a "residential carrier." FIG. 5 is a side view of the carrier 100 illustrating the manner in which the carrier 100 is intended to be carried by a person 402. The term "carrier" may used herein to refer to either a commercial carrier or a residential carrier.

Referring to FIG. 1, the body 101 of the carrier 100 comprises a substantially rectangular and substantially flat panel that includes a plurality of pockets 102, 104 and 106. The carrier 100 is preferably made from a substantially light-weight and flexible material so that it is manageable when filled with pool equipment and may be rolled into a tubular shape for easy storage and transport when not filled with pool equipment. Furthermore, the carrier 100 should be made from a strong and durable material that is preferably water-proof or water-resistant and chemical resistant. In the preferred embodiment, the carrier 100 is constructed from vinyl coated polyester.

As shown in FIG. 1A, the body 101 of the carrier 100 comprises a single panel or sheet of material that is folded at the top end around a support bar 114 and stitched or otherwise fastened together. The stitching or other fastening mechanism may be positioned along the width as well as along the height of the open edges of the fold, so that the support bar 114 is enveloped within the fold. The bottom end of the single panel of material is folded onto itself and is stitched or otherwise fastened in a similar fashion in order to form a pocket 106. Additional pieces of material 103 and 105 may then stitched or otherwise fastened to the body 101 of the carrier 100 in order to form pockets 102 and 104, respectively. A carrier 100 constructed in the above manner is simple and cost effective to produce.

In an alternate embodiment, the body 101 of the carrier 100 may comprise a single sheet of material with all pockets 102, 104 and 106 being formed by fastening additional pieces of material thereto. Forming pockets by fastening additional material to the body 101 allows greater freedom to include pleats or other customizations to the pockets. Pleats of course provide an amount of expandability to a pocket. In still another alternate embodiment, the body 101 of the carrier 100 may comprise a two-ply panel of material that is stitched along its edges to form an envelope. Additional stitching may be laid into the body 101 to create the pockets 102, 104 and 106.

As shown in to FIG. 1, an opening 111*a–c* may be created along the top of each pocket 102, 104 and 106. Each opening 111*a–c* may be outfitted with Velcro 113*a–c*, snaps, buttons, ties, buckles, or other fasteners known in the art. Although not shown in the figure, one or more of the pockets may be further subdivided into smaller pockets, such as by adding additional stitching. Furthermore, smaller external pockets may be layered onto any of the pockets 102, 104 and 106 by affixing additional layers of material to the carrier 100. As will be described below, the pockets of the carrier 100 may be specifically dimensioned for storing pieces and components of pool equipment that are of standard sizes and shapes.

Some or all of the pockets 102, 104, 106 may include a drainage point 112*a–c*. Drainage points 112*a–c* are optional but are included in the preferred embodiment so that run-off water from pool equipment does not add weight to the carrier 100. Advantageously, the bottom edge of each pocket may stitched in such a way as to form a slope for directing run-off water toward the drainage point 112. A drainage point 112 may simply comprise a hole or slit cut into the carrier 100. Alternately, a drainage point 112 may comprise a hole covered by a screen-like material that is held in place by a grommet. Other methods for providing drainage for the carrier 100 will occur to those of ordinary skill in the art and are therefore considered to be within the scope of the present invention. For example, openings may be created along the bottom edge of each pocket 102, 104 and 106 such that water may pass through one pocket into the next, and eventually out of the bottom of the carrier 100.

As mentioned, a support bar 114 may be affixed to the top edge of the carrier 100. The support bar may comprise a rigid member, such as a dowel constructed from metal, wood, plastic, graphite or other suitable material. The support bar 114 is preferably a length of half-inch diameter metal tubing, which provides adequate strength while being sufficiently light in weight. The support bar 114 may be embedded or enveloped in a fold of the carrier 100 and held in place by stitching or other fastening device. Alternately, the support bar 114 may be secured to the outside of the carrier 100. The support bar 114 is intended to bear most of the weight of the carrier 100 when the carrier 100 is hung from the shoulder of an individual by a shoulder strap 118. The support bar 100 also helps to maintain the shape of the carrier 100, which, as mentioned, is preferably constructed from a flexible material.

The shoulder strap 118 is affixed to the top edge of the carrier 100 in a typical fashion. The shoulder strap 118 is preferably secured to the support bar 114 so that the weight of the carrier 100 may be distributed along the support bar 114 when the carrier 100 is carried by the shoulder strap 118. The shoulder strap 118 is preferably about two inches wide and is adjustable in length to accommodate users of varying heights. A suitable shoulder strap 118 may be made from a nylon webbing material. A buckle 120 or other fastening device may provide both the desired adjustability as well as a quick-release feature. The preferred buckle 120 is a standard side-release plastic buckle that is durable and light weight. The shoulder strap 118 may also include a shoulder pad 122 for the comfort of the user.

A hose strap 124 is secured to the top edge of the carrier 100, preferably at the center. The hose strap 124 is used to attach a coiled pool hose to the carrier 100 and therefore should be attached to the support bar 114, or otherwise secured to the body 101 of the carrier 100, so that the weight of the pool hose 102 is supported by the support bar 114. The hose strap 124 may include a buckle 126 having a male portion 126*a* and a female portion 126*b*. Other fastening devices may be substituted for the buckle 126, such as a snap, Velcro, a tie, or the like.

As shown in FIG. 2, a pool hose 202 may be coiled or wound in a typical fashion. The hose strap 124 may then be looped around the coiled pool hose 202 and buckled, so that the coiled pool hose 202 is secured to and suspended from the carrier 100. The preferred hose strap 124 is approximately two inches wide and is adjustable in length so as to accommodate various lengths of pool hose 202.

As is also shown in FIG. 2, the carrier 100 may optionally include a key holder, which may simply be a grommet 204 through which a key ring 206 may be looped. In alternate embodiments, the key holder may comprise a key ring 206 that is stitched into or clipped onto the carrier 100. Still other types of key holders will be apparent to those of skill in the art and are considered to be within the scope of the present invention. The key holder may be included at any convenient location on the carrier 100, but is preferably included at a corner along the top edge of the carrier 100.

FIG. 3 and FIG. 4 demonstrate exemplary configurations for the various pockets 102, 104 and 106 of the carrier 100. The pockets 102, 104 and 106 may be designed to fit various types of commercial or residential pool equipment. While the pockets 102, 104 and 106 of the carrier 100 may be custom-fit to accommodate many types of pool equipment, it is preferable that they be designed to accommodate standard pool equipment items that are widely used by pool maintenance personnel. Also, while many configurations are possible, it is preferable to balance the weight of the carrier 100 by aligning the pockets 102, 104 and 106 such that the heavier pool equipment items (e.g., vacuum heads) are placed at bottom of the carrier 100. The overall dimensions of the carrier 100 may vary, depending on the size requirements of the pockets.

FIG. 3 illustrates an exemplary carrier 100 configured for storing commercial-grade pool equipment, which tends to be larger and more heavy-duty than residential-grade pool equipment. In a preferred embodiment, a first pocket 102 is sized to accommodate a standard commercial skim net 302, which may range in size from 19 inches to 30 inches. A commercial leaf rake, or other piece of pool equipment, ranging in size from 19 inches to 30 inches may also be fit into the first pocket 102. Accordingly, the first pocket 102 is preferably 32¾ inches in width and 10½ inches in height. The first pocket 102 may be large enough to also accommodate a commercial water test kit 308. A second pocket 104 may be sized to accommodate a standard commercial pool brush 304, which may range in size from 18 inches to 24 inches. As is known in the art, pool brushes 304 include curved brushes and straight brushes. Accordingly, the size of the second pocket 104 should be large enough to accommodate pool brushes 304 of varying shapes. In the preferred embodiment, the second pocket 104 has the same width (32¾ inches) as the first pocket 102 and is preferably 4 inches in height. A third pocket 106 is preferably sized to accommodate a standard commercial vacuum head 306, which may range in size from 22 inches to 29 inches. The third pocket 106 preferably has the same width (32¾ inches) as the first pocket 102 and is preferably 8 inches in height.

The overall dimensions of the body 101 of the preferred commercial carrier 100 are 32¾ inches in width and 29½ inches in height. The preferred dimensions of the body 101 of the commercial carrier 100 are provided as estimations. It should be noted that the overall height of the body 101 is equal to the sum of the respective heights of the pockets 102, 104 and 106 plus any space above, below or between the pockets 102, 104 and 106 and the support bar 114. Also, the dimensions of each pocket 102, 104 and 106 may vary based on the positioning and amount of stitching or other fastening device used to form the pockets. For example, double stitching or double seaming may be employed along the edges of a pocket in order to provide greater strength and durability. Double stitching or seaming will of course reduce the dimensions of the pocket.

FIG. 4 illustrates an exemplary carrier 100' configured for storing residential-grade pool equipment. The residential carrier 100' may be designed to be smaller than the commercial carrier 100 due to the relatively smaller size of residential pool equipment. Advantageously, a carrier 100' of smaller size is easier to handle and easier to store. In a preferred embodiment, a first pocket 102' is sized to accommodate a standard residential skim net 402 or leaf rake. The first pocket 102' may be large enough to also accommodate a residential water test kit 408. The first pocket 102' is preferably 20 inches in width and 12 inches in height. A second pocket 104' is preferably sized to accommodate a standard residential vacuum head 406. The second pocket 104' is positioned below the first pocket 102'. The second pocket 104' preferably has a width of 15 inches and a height of 10 inches. Also, the second pocket 104' is preferably pleated along its bottom edge. A third pocket 106' may be sized to accommodate a standard residential pool brush 404. As shown, the second pocket 104' and the third pocket 106' may be aligned side by side in order to minimize the size of the residential carrier 100'. In such a configuration, the third pocket 106' may only be large enough to accommodate the residential pool brush 404 in a side-ways orientation and protruding from the third pocket 106'. The third pocket preferably has a width of 4 inches and is preferably 10 inches in height.

The overall dimensions of the body 101' of the preferred residential carrier 100' are 20 inches in width and 30 inches in height. The preferred dimensions of the body 101' of the residential carrier 100' are provided as estimations. It should be noted that the overall height of the body 101' is equal to the sum of the respective heights of the pockets 102' and 104' plus any space above, below or between the pockets 102' and 104' and the support bar 114. Also, the dimensions of each pocket 102', 104' and 106' may vary based on the positioning and amount of stitching or other fastening device used to form the pockets. For example, double stitching or double seaming may be employed along the edges of a pocket in order to provide greater strength and durability. Double stitching or seaming will of course reduce the dimensions of the pocket.

FIG. 5 illustrates the preferred method for carrying the carrier 100 of the present invention. A person 402 uses the shoulder strap 118 to hang the carrier 100 from his/her shoulder in such a way that the pockets 102, 104 and 106 filled with pool equipment face away from his/her body. The hose strap 124 and buckle 126 secure a coiled pool hose 202 to the carrier 100, again with the pool hose 202 facing away from the body of the person 402. As should be apparent, the carrier 100 of the present invention provides a convenient method for handling an array of pool equipment. Use of the carrier 100 thus reduces the chance that pool equipment will be dropped or scraped along the ground, which reduces wear and tear on pool equipment The previous description of the preferred embodiments is provided to enable any person skilled in the art to make or use the present invention. Various modifications to these embodiments will be readily apparent to those skilled in the art, and the general principles defined herein may be applied to other embodiments without the use of the inventive faculty. Thus, the present invention is not intended to be limited to the embodiments shown herein but is to be accorded the widest scope consistent with the principles and novel features disclosed herein.

What is claimed is:

1. An apparatus for carrying pool cleaning equipment comprising:

a substantially flat and flexible panel partitioned into a plurality of pockets having openings along a front side of the panel;

a support bar affixed to a top edge of the panel and parallel to the top edge;

a shoulder strap affixed to the support bar; and a hose strap affixed to the support bar, the hose strap configured for securing a coiled pool hose to the front side of the panel.

2. The apparatus of claim 1, wherein the plurality of pockets comprises three pockets aligned vertically along the front side of the panel;

wherein a first pocket positioned in proximity to the top edge of the panel is sized to accommodate one of a commercial-grade leaf rake or a commercial-grade skimmer net;

wherein a second pocket positioned immediately below the first pocket is sized to accommodate a commercial-grade pool brush; and wherein a third pocket positioned immediately below the second pocket is sized to accommodate a commercial-grade vacuum head.

3. The apparatus of claim 1, wherein the plurality of pockets comprises:

a first pocket positioned in proximity to the top edge of the panel and sized to accommodate one of a residential-grade skimmer net or a residential-grade leaf rake;

a second pocket positioned immediately below the first pocket and sized to accommodate a residential-grade vacuum head; and a third pocket positioned immediately adjacent to the second pocket below the first pocket and sized to accommodate a residential-grade pool brush.

4. The apparatus of claim 1, wherein the shoulder strap includes a shoulder pad.

5. The apparatus of claim 1, wherein at least one of the pockets includes a drainage point.

6. The apparatus of claim 1, wherein the hose strap is adjustable in length so as to accommodate various lengths of pool hoses.

7. The apparatus of claim 1, wherein the openings of the pockets are outfitted with a fastening device.

8. The apparatus of claim 7, wherein the fastening device is Velcro.

9. The apparatus of claim 1, further comprising a key holder positioned on the panel.

10. The apparatus of claim 1, wherein the panel is constructed from a substantially water-resistant and substantially chemical resistant material.

11. The apparatus of claim 10, wherein the substantially water-resistant and substantially chemical resistant material comprises a vinyl coated polyester.

12. An apparatus for carrying pool cleaning equipment comprising:

a support bar affixed to a top edge of a substantially flat and flexible panel;

a first pocket positioned on a front side of the panel in proximity to the top edge of the panel, the first pocket sized to accommodate one of a commercial-grade leaf rake or a commercial-grade skimmer net;

a second pocket positioned on the front side of the panel immediately below the first pocket, the second pocket sized to accommodate a commercial-grade pool brush;

a third pocket positioned on the front side of the panel immediately below the second pocket, the third pocket sized to accommodate a commercial-grade vacuum head; and a hose strap affixed to the support bar, the hose strap configured for securing a coiled pool hose to the front side of the panel.

13. The apparatus of claim 12, further comprising a shoulder strap affixed to the support bar.

14. The apparatus of claim 13, wherein the shoulder strap includes a shoulder pad.

15. The apparatus of claim 12, wherein the hose strap is adjustable in length so as to accommodate various lengths of pool hoses.

16. The apparatus of clam 12, wherein the panel is constructed from a substantially water-resistant and substantially chemical resistant material.

17. An apparatus for carrying pool cleaning equipment comprising:

a support bar affixed to a top edge of a substantially flat and flexible panel;

a first pocket position on a front side of the panel in proximity to the top edge of the panel, the first pocket sized to accommodate one of a residential-grade skimmer net or a residential-grade leaf rake;

a second pocket position on the front side of the panel immediately below the first pocket, the second pocket sized to accommodate a residential-grade pool brush;

a third pocket positioned on the front side of the panel immediately adjacent to the second pocket below the first pocket and the sized to accommodate a residential-grade pool brush; and a hose strap affixed to the support bar, the hose strap configured for securing a coiled pool hose to the front side of the panel.

18. The apparatus of claim 17, wherein at least on of the pockets is pleated.

19. The apparatus of claim 17, further comprising a shoulder strap affixed to the support bar.

20. The apparatus of claim 17, wherein the panel is constructed from a substantially water-resistant and substantially chemical resistant material.

* * * * *